US006361450B1

(12) United States Patent
Huang

(10) Patent No.: US 6,361,450 B1
(45) Date of Patent: Mar. 26, 2002

(54) GOLF CLUB SHAFT GRIP ASSEMBLY

(76) Inventor: Ben Huang, 16652 Gemini La., Huntington Beach, CA (US) 92647

( * ) Notice: Subject to any disclaimer, the term of this patent is extended or adjusted under 35 U.S.C. 154(b) by 0 days.

(21) Appl. No.: 09/497,749

(22) Filed: Feb. 4, 2000

(51) Int. Cl.[7] ..... A63B 53/04; A63B 53/06; A63B 53/08

(52) U.S. Cl. ..... 473/300; 473/301; 473/302; 473/298

(58) Field of Search ..... 473/300, 301, 473/302, 305, 298; 29/283

(56) References Cited

U.S. PATENT DOCUMENTS 1,943,399 A * 1/1934 Smith ..... 273/81
5,584,482 A * 12/1996 Huang ..... 273/75
5,671,923 A * 9/1997 Huang ..... 473/300
5,797,813 A * 8/1998 Huang ..... 473/549
5,827,129 A * 10/1998 Huang ..... 473/301
5,895,329 A * 4/1999 Huang ..... 473/302

* cited by examiner

*Primary Examiner*—Jeanette Chapman
*Assistant Examiner*—Sneh Varma
(74) *Attorney, Agent, or Firm*—Fulwider Patton Lee & Utecht, LLP

(57) ABSTRACT

A grip assembly for the handle of a golf club shaft where the grip includes a resilient underlisting sleeve over which is spirally wrapped a resilient strip. An elastic finishing collar is interposed between the lower end of the sleeve and strip to secure such sleeve and strip to the handle of a golf club shaft. An elastic finishing collar is interposed between the lower end of the sleeve and the strip to secure such sleeve and strip to the handle of a golf club shaft as a substitute for a synthetic plastic ferrule or length of finishing tape utilized in the prior art.

4 Claims, 2 Drawing Sheets

FIG. 1
PRIOR ART
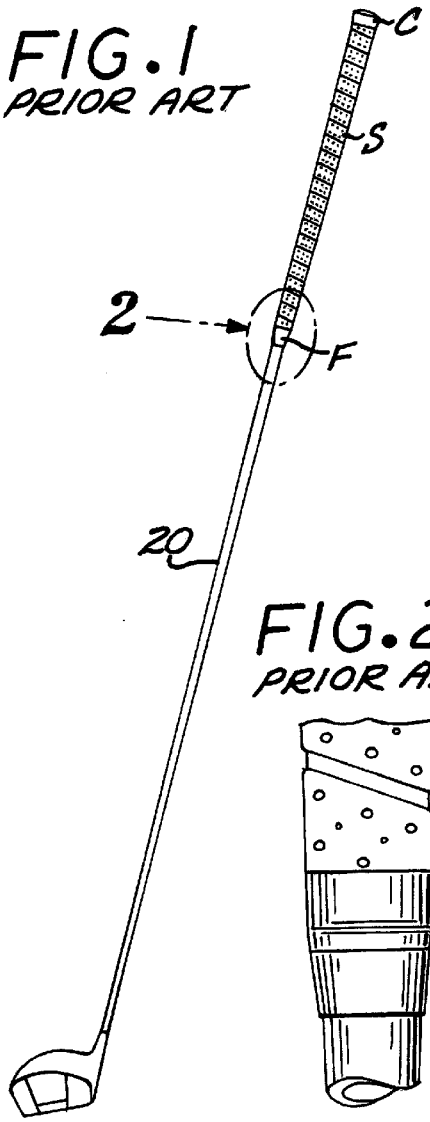
FIG. 2
PRIOR ART
FIG. 2 A
PRIOR ART
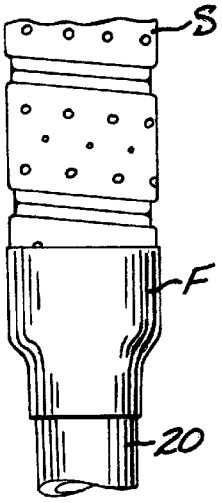
FIG. 3
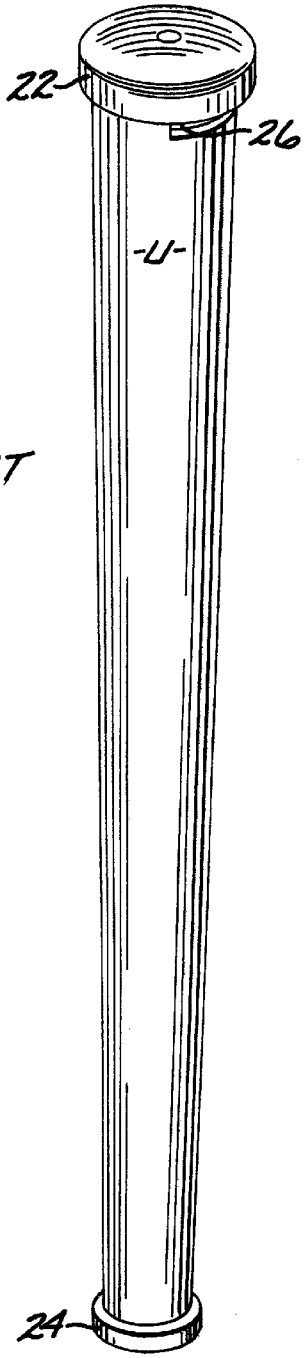
FIG. 4
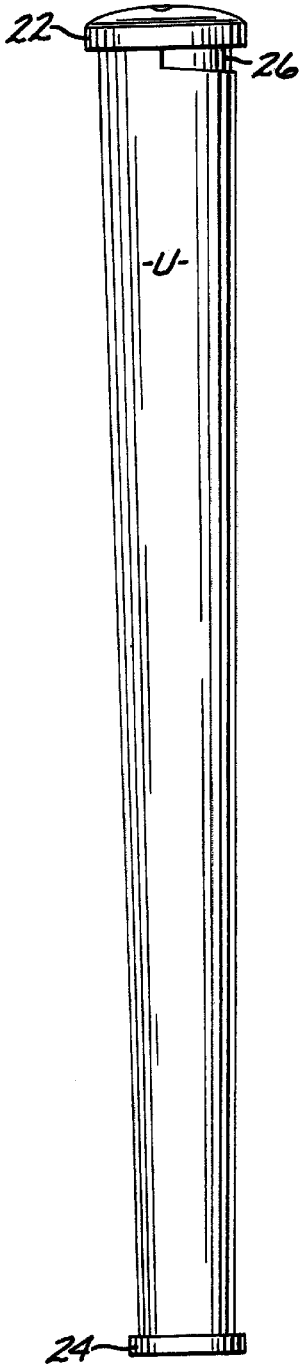

GOLF CLUB SHAFT GRIP ASSEMBLY

BACKGROUND OF THE INVENTION

The present invention relates to an improved grip assembly for golf clubs and other sporting equipment employing handles subject to shock when such devices are impacted.

It is well known that the shock generated by impact between a golf club and a golf ball can adversely effect muscle tissue and arm joints. The energy generated by such impact is usually of high frequency and short duration with rapid decay and which is often known as "impact shock." Tight grasping of a golf club grip to keep it from slipping in a users hands contributes to such impact shock.

Applicant has previously developed resilient grips which successfully reduce or even eliminate impact shock to the muscle and arm joint of the users of golf clubs. See for example U.S. Pat. No. 5,797,813, granted to applicant Aug. 25, 1998. Such earlier grips utilize a polyurethane layer bonded to a felt layer to define a resilient strip, which is spirally wrapped around an underlisting sleeve, with such underlisting sleeve being slipped over the handle portion of a golf club shaft. After the underlisting sleeve has been properly positioned upon the golf club shaft, a synthetic plastic ferrule such as designated 56 in FIG. 18 of my U.S. Pat. No. 5,895,329 secures the grip in place on the handle of the golf club shaft. Alternatively, the lower end of the resilient strip maybe secured to the lower end of the underlisting sleeve by a length of finishing tape. Installation of a ferrule is labor intensive, while the use of finishing tape does not provide a high quality commercial image.

SUMMARY OF THE INVENTION

The golf club grip assembly of my present invention eliminates the disadvantages of the afore mention synthetic plastic ferrule, or the use of finishing tape.

BRIEF DESCRIPTION OF THE DRAWINGS

FIGS. 1, 2 and 2A show typical prior art golf club shaft grip assemblies which are subject to the aforementioned disadvantages;

FIG. 3 is a perspective view of an underlisting sleeve element of a golf club shaft grip assembly embodying the present invention;

FIG. 4 is a side elevational view of an underlisting sleeve element of a golf club shaft grip assembly embodying the present invention;

DESCRIPTION OF A PREFERRED EMBODIMENT

FIGS. 1 and 2 show a typical prior art golf club grip assembly, where the golf club C has a shaft 20 upon the handle portion of which is installed a resilient slip-on grip G provided with a prior art ferrule F that secures the lower end of the grip G to the golf club shaft. FIG. 2 is an enlarged view of the encircled area 2 of FIG. 1. FIGS. 1 and 2 correspond to FIGS. 17 and 18 of my U.S. Pat. No. 5,895,329. Ferrule F is made of an inelastic synthetic plastic material. FIG. 2A is a view similar to FIG. 2 showing a length of finishing tape T spirally wrapped about the lower end of a resilient strip S to secure such strip to an underlisting sleeve U in accordance with the prior art.

Figure 5:
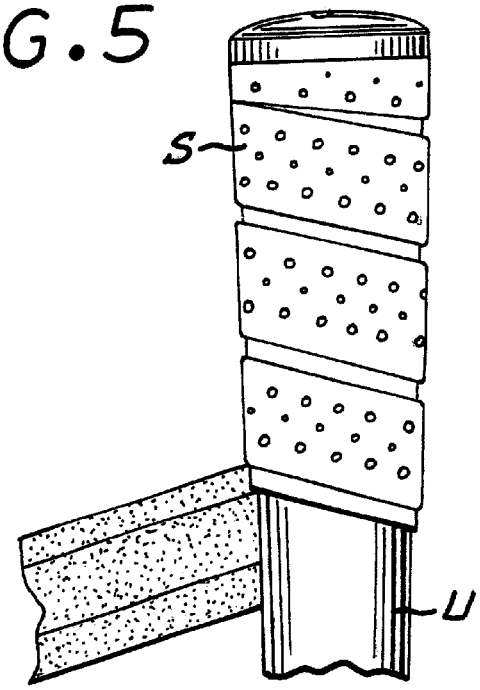
FIG. 5 is a broken side elevational view of a resilient strip being spirally wrapped about the underlisting sleeve of FIGS. 4 and 5.

Referring now to FIGS. 4 and 5 there is shown a resilient underlisting sleeve U employed in my new grip assembly. Such sleeve U is similar to that described in my U.S. Pat. No. 5,797,813 and includes an integral cap 22. The lower end of the sleeve is formed with an integral nipple 24. The upper portion of the sleeve view is formed with a groove 26 to receive a tip of a polyurethane-felt strip S, such as that described in my U.S. Pat. No. 5,797,813. When strip S is spirally wrapped about the body of the underlisfing sleeve U as shown in FIG. 6, the lower end of such strip abuts the upper surface of nipple 24, as shown in FIG. 8.

Figure 6:
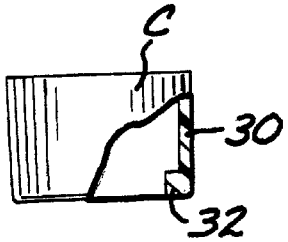
FIG. 6 is a side elevational view of a finishing collar element of a golf club shaft grip assembly embodying the present invention, taken partly in section.
Figure 7:
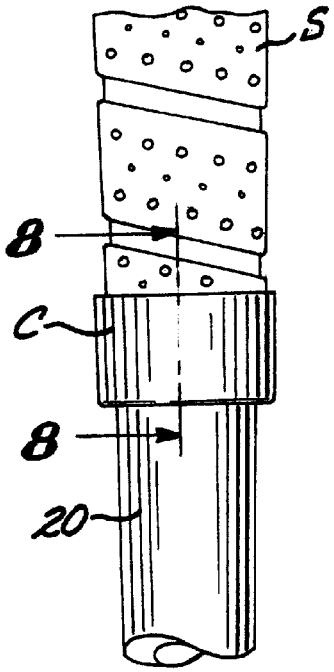
FIG. 7 is a broken side elevational view of the lower portion of said grip assembly.
Figure 8:
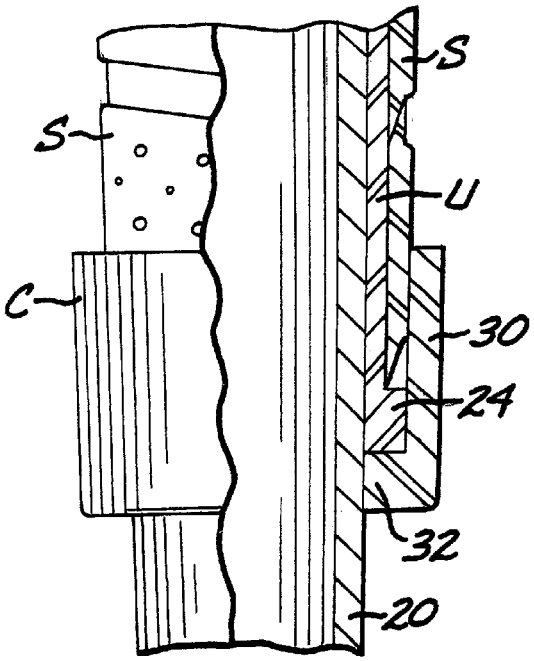
FIG. 8 is a vertical sectional view taken in enlarge scale along line 8—8 of FIG. 7.

As a substitute for the aforedescribed prior art ferrule F or finishing tape T, my new grip assembly utilizes a finishing collar C shown in FIGS. 6, 7 and 8. Referring thereto, collar C is fabricated from a resilient material which must have an elasticity which enables it to expand sufficiently to be received by the lower end of strip S and nipple 24 as indicated in FIG. 8, but be capable of remaining in fixed position on the strip and nipple. The finishing collar is slipped over the nipple 24 and the lower portion of wound strip S before the underlisting sleeve U is slipped over the handle of the golf club shaft. Such material may be formulated from a combination comprised primarily of ethylene-propene and natural rubber. If desired an adhesive may be interposed between the finishing collar on the nipple and/or the lower portion of the wound strip.

Collar C shown in FIGS. 6, 7 and 8 is of frusto-conical configuration and includes sidewalls 30, the lower ends of which are formed with an integral radially inwardly extending lip 32. The upper surface of lip 32 engages the lower surface of nipple 24 when the grip G has been properly positioned upon the handle of the golf club shaft, as shown in FIG. 8. When so positioned, finishing collar CF will securely retain the lower end of the underlisting sleeve U and strip S upon the handle of the golf club shaft, both during play and when the golf club is urged into or pulled from a golf club bag.

Finishing collar C eliminates the labor required to install the aforedescribed prior art ferrule F, and therefore decreases the cost of manufacturing golf grips, while providing a high quality appearance of the installed grip, as compared to the appearance of finishing tape. Moreover, the cost of my finishing collar C and installing such collar is less than the cost of a ferrule.

It will be understood that various modifications and changes may be made with respect to the above-described embodiment without departing from the spirit and scope of the present invention.

What is claimed is:

1. A grip assembly for the handle of a golf club shaft, said assembly comprising:

a resilient underlisting sleeve formed at its upper end with a cap and at its lower end with a nipple, the sleeve being telescopically received by the shaft handle;

a resilient strip spirally wrapped about the underlisting sleeve between the underside of the cap and the upper surface of the nipple; and a finishing collar having sidewalls the lower ends of which are formed with a radially inwarding extending lip that is in engagement with the lower surface of the nipple, with such sidewalls encompassing the nipple and the lower portion of the resilient strip, said finishing collar having an elasticity which enables it to be expanded sufficiently to be slipped over the lower end of the sleeve and strip, but to remain positioned over the lower end of the sleeve and strip to securely retain the lower portion of the sleeve to the handle of the golf club.

2. A grip assembly as set forth in claim 1 wherein the upper portion of the underlisting sleeve is formed with a groove that receives the upper end of the resilient strip.

3. A grip assembly as set forth in claim 1 wherein the finishing collar is formed of a combination consisting primarily of ethylene-propene and natural rubber.

4. A grip assembly as set forth in claim 2 wherein the finishing collar is formed of a combination consisting primarily of ethylene-propene and natural rubber.

* * * * *